US008649715B2

(12) United States Patent
Gonda

(10) Patent No.: US 8,649,715 B2
(45) Date of Patent: Feb. 11, 2014

(54) IMAGE FORMING APPARATUS

(75) Inventor: Takashi Gonda, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 60 days.

(21) Appl. No.: 13/237,434

(22) Filed: Sep. 20, 2011

(65) Prior Publication Data

US 2012/0082486 A1 Apr. 5, 2012

(30) Foreign Application Priority Data

Oct. 4, 2010 (JP) ..... 2010-224973

(51) Int. Cl.
*G03G 15/09* (2006.01)
*G03G 15/08* (2006.01)

(52) U.S. Cl.
USPC ..... 399/277; 399/276; 399/257

(58) Field of Classification Search
USPC ..... 399/255, 257, 258, 276, 277, 359, 360
See application file for complete search history.

(56) References Cited

U.S. PATENT DOCUMENTS 5,638,159 A 6/1997 Kai et al.

FOREIGN PATENT DOCUMENTS

JP 63138381 A * 6/1988
JP 01-108571 A 4/1989
JP 09-166913 A 6/1997
JP 3581720 B2 10/2004
JP 2009103899 A * 5/2009

OTHER PUBLICATIONS

Office Action (Notification of Reason(s) for Refusal) dated Sep. 18, 2012, issued in corresponding Japanese Patent Application No. 2010-224973, and an English Translation thereof. (7 pages).

* cited by examiner

*Primary Examiner* — David Gray
*Assistant Examiner* — Erika J Villaluna
(74) *Attorney, Agent, or Firm* — Buchanan Ingersoll & Rooney PC

(57) ABSTRACT

An image forming apparatus includes: a developing device that allows a developer to be retained on a developer carrier having a magnet member equipped with a plurality of magnetic poles mounted on an inner periphery thereof and rotates the developer carrier to deliver the developer to an image carrier and that forms a toner image by supplying the toner of the developer to the image carrier by applying a developing bias voltage from a bias voltage source between the developer carrier and the image carrier; a transfer device for transferring the toner image formed on the image carrier to a transfer receiving material; a toner recovery device for recovering the toner remaining on the surface of the image carrier after the transfer of the toner image; and a toner return device for returning to the developing device the toner recovered by the toner recovery device.

3 Claims, 3 Drawing Sheets

IMAGE FORMING APPARATUS

RELATED APPLICATION

The priority application Number Japanese Patent Application 2010-224973 upon which this application is based is hereby incorporated by reference.

BACKGROUND OF THE INVENTION

1. Field of the Invention

The present invention relates to an electrophotographic image forming apparatus such as copiers, printers, facsimiles and combined machines thereof.

2. Description of the Related Art

It is a common practice in the electrophotographic image forming apparatus such as copiers, printers, facsimiles and combined machines thereof that the developing device supplies the toner to an electrostatic latent image formed on the image carrier so as to form thereon a toner image corresponding to the electrostatic latent image.

After the toner image thus formed on the image carrier is transferred by the transfer device to the transfer receiving material such as a recording medium or an intermediate transfer belt, the toner recovery device recovers from the surface of the image carrier the toner remaining thereon after the transfer of the toner image. There is also known an apparatus which employs the toner return device for returning to the developing device the toner recovered by the toner recovery device so that the recovered toner is put to effective use.

The above developing device includes a developing device of a single component development system using a toner alone as the developer and a developing device of a two-component development system using a developer containing the toner and the carrier. The developing device of the two-component development system using the developer containing the toner and the carrier is superior in terms of quick and adequate toner charging for facilitating high-speed image formation.

In the above-described developing device of the two-component development system, the developer containing the toner and the carrier is mixingly agitated to charge the toner by contact with the carrier. The developer containing the charged toner is retained on the developer carrier having the magnet member equipped with the magnetic poles mounted on the inner periphery thereof. The developer carrier is rotated to deliver the retained developer to the image carrier.

The toner of the developer retained on the developer carrier is supplied to the image carrier by applying the developing bias voltage from the bias voltage source between the developer carrier and the image carrier. Thus, the toner image corresponding to the electrostatic latent image is formed on the surface of the image carrier.

In a case where the developer is decreased in toner content in consequence of the above-described toner supply to the image carrier, a toner replenisher replenishes the developing device with the toner.

The above developing device of the two-component development system has the following problem. As the developer is used over a long period of time, the carrier in the developer is gradually deteriorated so as to become incapable of adequately charging the toner. As a result, the developing device becomes incapable of accomplishing proper image formation.

It has been a conventional practice to remove the developer suffering from the carrier deterioration from the developing device for replacement with a fresh developer or to replace the developing device per se with a new one.

However, in the case where the developer suffering from the carrier deterioration is removed from the developing device for replacement with a fresh one, or where the developing device per se is replaced with a new one, the developer actually contains a substantial amount of toner that is still usable. Namely, there is a problem that the usable toner remaining in the developer is wastefully discarded.

More recently, therefore, there has been proposed an apparatus wherein the above developing device is provided with separation means for separating the toner from the developer to be removed, as disclosed in Japanese Patent Publication No.3581720. The separation means includes a developer collection portion and a toner recovery portion. A charge of the opposite polarity to that of the toner is applied to a developer collection sleeve so as to separate the toner from the developer to be removed. The separated toner is returned to the developing device for recycling.

However, in the case where the developing device is provided with the developer collection portion and the toner recovery portion as the separation means for separating the toner from the developer to be removed, and the charge of the opposite polarity to that of the toner is applied to the developer collection sleeve for separating the toner from the developer to be removed, the developing device need be equipped with many devices. Thus, the developing device is increased in cost and in size.

SUMMARY OF THE INVENTION

According to the invention, an image forming apparatus comprises: a developing device that allows a developer including a toner and a carrier to be retained on a developer carrier having a magnet member equipped with a plurality of magnetic poles mounted on an inner periphery thereof and rotates the developer carrier to deliver the developer to an image carrier and that forms a toner image by supplying the toner of the developer to the image carrier by applying a developing bias voltage from a bias voltage source between the developer carrier and the image carrier; a transfer device for transferring the toner image formed on the image carrier to a transfer receiving material; a toner recovery device for recovering the toner remaining on the surface of the image carrier after the transfer of the toner image; and a toner return device for returning to the developing device the toner recovered by the toner recovery device, wherein the magnet member is rotated to reposition the magnetic poles thereof at the time of toner recovery operation in which the toner supplied from the developer carrier to the image carrier is prevented from being transferred to the transfer receiving material while the toner recovery device is operated to recover the toner from the developer in the developing device.

These and other objects, advantages and features of the invention will become apparent from the following description thereof taken in conjunction with the accompanying drawings which illustrate a specific embodiment of the invention.

DESCRIPTION OF THE PREFERRED EMBODIMENT

An image forming apparatus according to an embodiment of the invention will hereinbelow be described in detail with reference to the accompanying drawings. It is to be noted that the image forming apparatus of the invention is not limited to the following embodiment but changes or modifications may be made thereto as needed so long as such changes or modifications do not depart from the scope of the invention.

Figure 1:
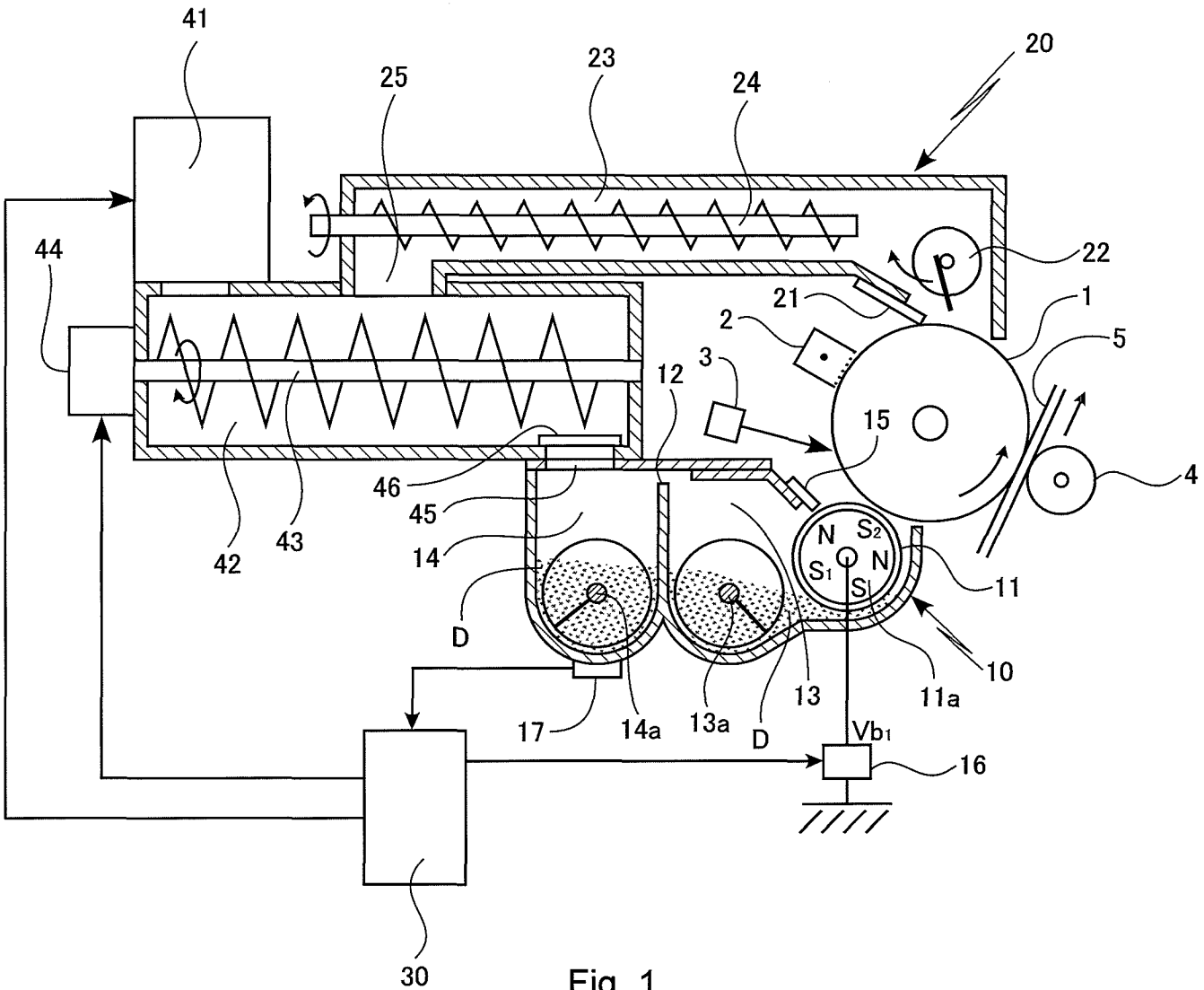
FIG. 1 is a schematic diagram illustrating an image forming apparatus according to one embodiment of the invention wherein an image is formed by transferring a toner image formed on an image carrier to a transfer receiving material.

As shown in FIG. 1, the image forming apparatus of the embodiment operates as follows. A surface of an image carrier 1 comprising a rotary photosensitive drum is charged by a charger 2. Subsequently, a latent image forming device 3 employing a laser or the like exposes the surface of the image carrier 1 to light according to image information, to thereby form an electrostatic latent image on the image carrier 1.

A developing device 10 containing therein a developer D including a toner and a carrier supplies the toner of the developer D to the electrostatic latent image formed on the image carrier 1. Thus, a toner image corresponding to the electrostatic latent image is formed on the image carrier 1.

Subsequently, the toner image thus formed on the image carrier 1 is transported to be placed opposite a transfer device 4 in the form of a roller, while a transfer receiving material 5 such as a recording sheet or an intermediate transfer belt is brought into space between the image carrier 1 and the transfer device 4. Thus, the toner image formed on the surface of the image carrier 1 is transferred to the transfer receiving material 5 by means of the transfer device 4.

An edge of a cleaning member 21 provided at a toner recovery device 20 is pressed against the surface of the image carrier 1 after the image transfer. The toner remaining on the surface of the image carrier 1 is recovered by the cleaning member 21 and collected in the toner recovery device 20.

Subsequently, the toner thus recovered from the surface of the image carrier 1 and collected in the toner recovery device 20 is returned to the developing device 10 by means of a return device.

In the above-described developing device 10, a magnet member 11*a* including a plurality of magnetic poles N, S, . . . is mounted on an inner periphery of a developer carrier 11 comprising a rotary development roller. This developer carrier 11 is disposed in opposed relation to the above image carrier 1.

Within the developing device 10, a partitioning wall 12 extends in an axial direction of the developer carrier 11. This partitioning wall 12 divides the interior of the developing device 10 into a first developer transport portion 13 and a second developer transport portion 14, which are provided with a first agitating/transporting member 13*a* and a second agitating/transporting member 14*a*, respectively. The agitating/transporting members transport the developer D while mixingly agitating the developer D.

The above first agitating/transporting member 13*a* and second agitating/transporting member 14*a* are brought into rotation. In the first developer transport portion 13, the developer D is transported along the developer carrier 11 and supplied to the developer carrier 11. In the second developer transport portion 14, the developer D is transported in the opposite direction to the developer movement in the first developer transport portion 13 so that the developer D is circulated between the second and first developer transport portions through circulation ports (not shown) formed at opposite ends of the partitioning wall 12.

As described above, the developing device 10 supplies the toner of the developer D to an area of the electrostatic latent image formed on the surface of the image carrier 1 so as to form thereon the toner image corresponding to the electrostatic latent image. In this process, the magnetic poles N, S, . . . of the magnet member 11*a* are set to predetermined positions for development. Accordingly, a magnetic pole $S_1$ of the magnet member 11*a*, that is located opposite the developer D in the developing device 10, allows the developer carrier 11 to retain the developer D on an outer periphery thereof.

The developer carrier 11 is rotated to transport the retained developer D toward the image carrier 11. Meanwhile the amount of developer D so carried on the developer carrier 11 to the image carrier 1 is regulated by a regulating member 15 which is opposed to and spaced a required distance away from the developer carrier 11.

As regulated in this manner, the developer D is carried on the developer carrier 11 to be placed opposite the image carrier 1. A controller 30 drives a bias voltage source 16 to apply a proper developing bias voltage $Vb_1$ between the developer carrier 11 and the image carrier 1 for adequately supplying the toner of the developer D to the area of the electrostatic latent image formed on the surface of the image carrier 1. Thus, the toner image corresponding to the electrostatic latent image is formed on the surface of the image carrier 1.

In the developing device 10, the second developer transport portion 14 is provided with a toner density sensor 17 for detecting a toner content of the developer D. In the case of a significant decrease in the toner content of the developer D in consequence of supplying the toner of the developer D to the surface of the image carrier 1 as described above, the toner density sensor 17 detects such a toner decrease and outputs a detection result to the controller 30.

In a case where the toner content of the developer D falls to a predetermined value or less, a toner shortage is detected by the toner density sensor 17. In response to this, the controller 30 drives a toner replenisher 41 to supply the toner to a toner replenishment path 42 and also drives a rotating device 44 to rotate a toner transporting member 43 comprising a screw member disposed in the toner replenishment path 42. The toner thus fed into the toner replenishment path 42 is transported by rotating the toner transporting member 43 so that the toner is delivered to a toner supply port 45 disposed between the toner replenishment path 42 and the second developer transport portion 14. The toner is fed into the second developer transport portion 14 of the developing device 10 through this toner supply port 45.

The toner recovered from the surface of the image carrier 1 by the toner recovery device 20 is returned to the developing device 10 by means of a toner return device. The toner recovery device 20 is provided with a recovered-toner advancing member 22 which is a rotating member. The toner recovered from the surface of the image carrier 1 by the cleaning member 21 is advanced into a recovered-toner transport path 23 by the recovered-toner advancing member 22.

In the recovered-toner transport path 23, a recovered-toner transporting member 24 is provided for transporting the toner recovered and delivered therein as described above. The toner recovered and delivered into the recovered-toner transport path 23 is transported by rotating the recovered-toner transporting member 24. Thus, the recovered toner is delivered to a recovered-toner inlet port 25 disposed between the recovered-toner transport path 23 and the toner replenishment path 42. Thus, the recovered toner is fed into the toner replenishment path 42 through the recovered-toner inlet port 25.

The recovered toner fed into the toner replenishment path 42 is transported by rotating the toner transporting member 43 in the same way as in the above described toner replenishment. The recovered toner is delivered to the toner supply port 45 disposed between the toner replenishment path 42 and the second developer transport portion 14 and is returned into the second developer transport portion 14 of the developing device 10 through the toner supply port 45.

In the image forming apparatus according to the embodiment, the above-described image development by the developing device 10 involves gradual deterioration of the carrier contained in the developer D. While the developing device 10 carries on the image development, the developer D is mixingly agitated by the first agitating/transporting member 13*a* and the second agitating/transporting member 14*a*, gradually deteriorating the carrier contained therein.

Before the developer D suffering from the carrier deterioration as described above is removed from the developing device 10, the image forming apparatus of this embodiment performs a toner recovery operation wherein the toner recovery device 20 recovers the toner from the developer D loaded in the developing device 10.

The image forming apparatus of the embodiment performs the toner recovery operation as follows to recover the toner from the developer D loaded in the developing device 10. As described above, the electrostatic latent image is formed on the surface of the image carrier 1 by charging the surface of the image carrier 1 by means of the charger 2, followed by exposing the image carrier surface 1 to light by means of the latent image forming device 3.

Figure 2:
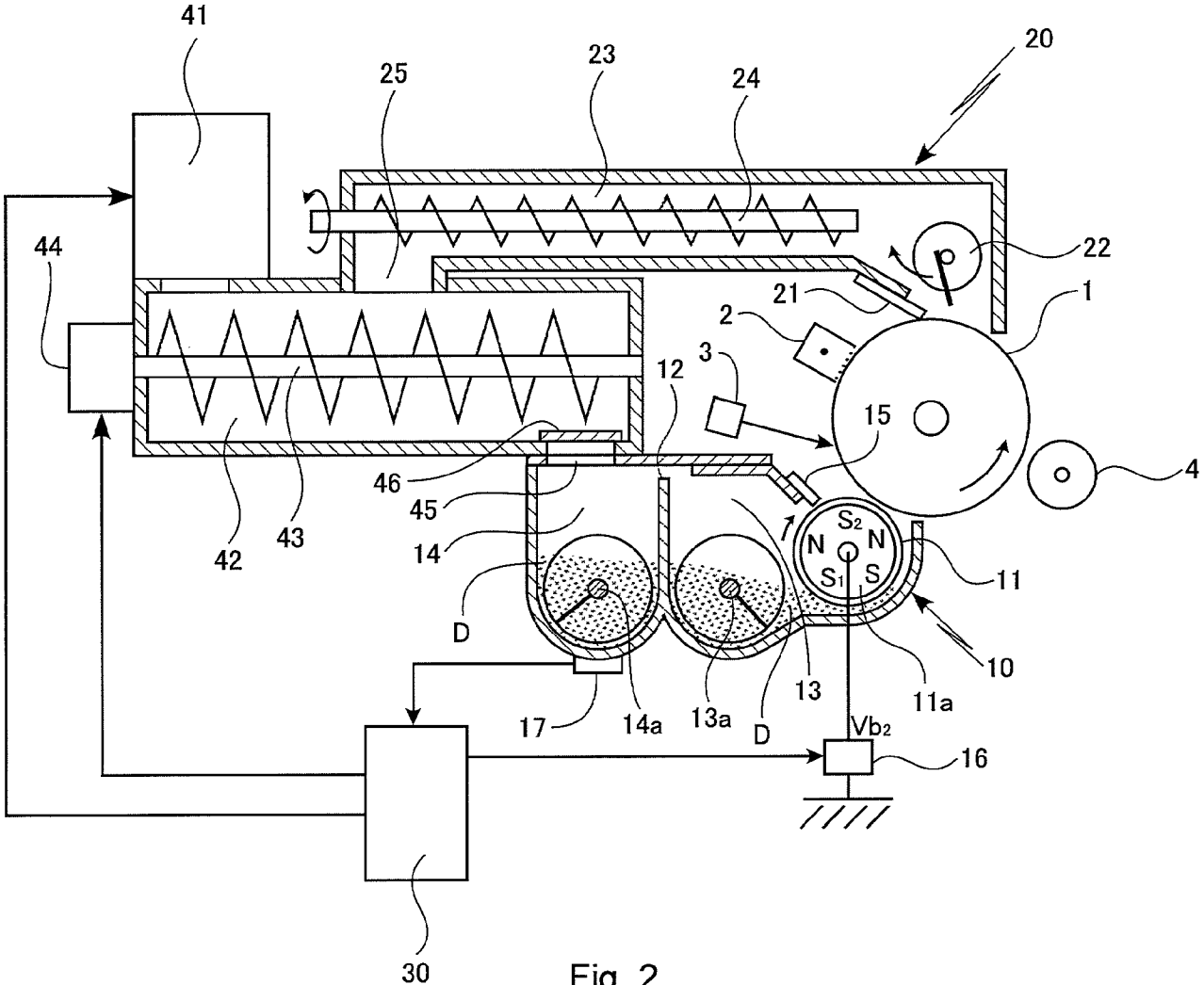
FIG. 2 is a schematic diagram illustrating the image forming apparatus of the above embodiment wherein a magnet member mounted on an inner periphery of a developer carrier is rotated to reposition magnetic poles thereof at the time of toner recovery operation in which the toner supplied to the image carrier is prevented from being transferred to the transfer receiving material while a toner recovery device is operated to recover the toner.
Figure 3:
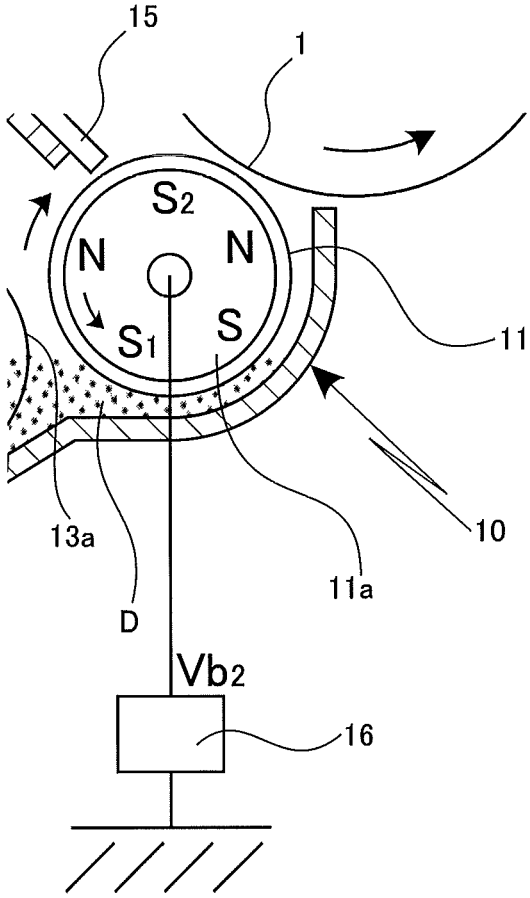
FIG. 3 is a fragmentary illustration of the image forming apparatus of the above embodiment wherein the magnet member mounted on the inner periphery of the developer carrier is rotated to reposition the magnetic poles thereof at the time of toner recovery operation in which the toner supplied to the image carrier is prevented from being transferred to the transfer receiving material while the toner recovery device is operated to recover the toner.

Then, the developing device 10 supplies the toner of the developer D to the electrostatic latent image so formed on the image carrier 1. According to the embodiment as shown in FIG. 2 and FIG. 3, the magnet member 11*a* is rotated a little to bring the magnetic pole $S_1$ of the magnet member 11*a*, that is located opposite the developer D in the developing device 10, closer to the developer D in the developing device 10. In addition, the controller 30 controls the developing bias voltage of the bias voltage source 16 that is applied between the developer carrier 11 and the image carrier 1. That is, the bias voltage source is controlled to apply a predetermined developing bias voltage $Vb_2$ more positive than the developing bias voltage $Vb_1$ for image formation, thereby causing more toner to be supplied to the image carrier 1.

When the magnetic pole $S_1$ of the magnet member 11*a* is brought closer to the developer D in the developing device 10, the magnetic pole $S_1$ of the magnet member 11*a* strongly attracts the developer D in the developing device 10, allowing the developer carrier 11 to carry a sufficient amount of developer D thereon to the image carrier 1.

The following effects are obtained if the developing bias voltage $Vb_2$ of the developing bias voltage source 16 applied between the developer carrier 11 and the image carrier 1 is raised from the developing bias voltage $Vb_1$ for image formation in a positive direction to supply the toner to the image carrier 1. That is, less of the carrier of the developer D delivered to be placed opposite the image carrier 1 is supplied to the image carrier 1, while more of the toner of the developer D is supplied to the image carrier 1. It is therefore ensured that the toner of the developer D is adequately supplied to the image carrier 1 even if the magnetic pole $S_2$, opposed to the image carrier 1 at the image development, of the magnet member 11*a* is rotated to be displaced. To further increase the amount of toner supplied to the image carrier 1, the above-described latent image forming device 3 may preferably form, on the surface of the image carrier 1, an electrostatic latent image corresponding to a solid image.

When the toner recovery operation is performed by the toner recovery device 20 to recover the toner from the developer D in the developing device, the transfer receiving material 5 is inhibited from being introduced into space between the image carrier 1 supplied with the toner as described above and the transfer device 4. Specifically, the image carrier 1 and the transfer device 4 are spaced apart while the toner supplied to the image carrier 1 is introduced into the toner recovery device 20 instead of being transferred to the transfer receiving material 5.

In this toner recovery device 20, the toner supplied to the image carrier 1 as described above is recovered therefrom by means of the cleaning member 21 and the recovered toner is introduced into the recovered-toner transport path 23 by means of the recovered-toner advancing member 22 which rotates. The toner thus introduced into the recovered-toner transport path 23 is transported by the recovered-toner transporting member 24 to the recovered-toner inlet port 25 disposed between the recovered-toner transport path 23 and the above-described toner replenishment path 42. The recovered toner is introduced into the toner replenishment path 42 through the recovered-toner inlet port 25.

The following operation is performed in the toner replenishment path 42 to which the toner is supplied. The controller 30 inhibits the rotating device 44 from rotating the toner transporting member 43 so as to disable the toner transporting member 43 to transport the toner fed into the toner replenishment path 42. By doing so, the toner fed into the toner replenishment path 42 is prevented from being returned to the developing device 10 through the toner supply port 45 but is allowed to accumulate in the toner replenishment path 42.

Thus, the toner of the developer D loaded in the developing device 10 is sequentially supplied to the image carrier 1 and allowed to accumulate in the toner replenishment path 42. Accordingly, the developer D loaded in the developing device 10 is gradually decreased in the toner content.

The amount of toner remaining in the developer D is reduced in this manner. When the toner density of the developer D is reduced to a predetermined value or less, the developer D in the developing device 10 may be replaced with a fresh one or otherwise, the developing device 10 per se may be replaced with a new one. Thus, the amount of wastefully discarded toner is notably reduced.

After the developer D in the developing device 10 is replaced with a fresh developer or otherwise, the developing device 10 per se is replaced with a new one, as described above, the toner accumulated in the toner replenishment path 42 may be supplied to the developing device 10 through the above-described toner supply port 45. This facilitates the effective use of the toner accumulated in the toner replenishment path 42.

As described above, the toner recovered by the toner recovery device 20 is accumulated in the toner replenishment path 42. In this regard, it is preferred to provide a shutter 46 adapted to open and close the toner supply port 45 in order to make sure that the toner fed into the toner replenishment path 42 is prevented from being returned to the developing device 10. It is preferred that the shutter 46 closes the toner supply port 45 to allow the recovered toner to accumulate in the toner replenishment path 42. Further, a toner storage portion for accumulation of the recovered toner may also be provided independently from the toner replenishment path 42.

When the toner recovery operation according to the embodiment is performed to recover the toner from the developer D in the developing device 10, the magnet member 11*a* is rotated a little to bring the magnetic pole $S_1$ thereof closer to the developer D in the developing device 10. In addition, the bias voltage source 16 applies, between the developer carrier 11 and the image carrier 1, the predetermined developing bias voltage $Vb_2$ that is raised from the developing bias voltage $Vb_1$ for image formation in the positive direction to supply the toner to the image carrier 1. However, the developing bias voltage applied between the developer carrier 11 and the image carrier 1 by the bias voltage source 16 may not be raised to the predetermined developing bias voltage $Vb_2$ at once. It is also possible to raise the developing bias voltage stepwise in the positive direction to supply the toner to the image carrier 1.

It is also possible to take a procedure wherein the developing bias voltage of the bias voltage source 16 applied between the developer carrier 11 and the image carrier 1 is raised to the predetermined developing bias voltage $Vb_2$ at once or stepwise and then, the magnet member 11*a* is rotated a little to bring the magnetic pole $S_1$ thereof closer to the developer D in the developing device 10.

In a case where the developer in the developing device suffers from the carrier deterioration and hence, is replaced with a fresh developer, the image forming apparatus of the invention performs the toner recovery operation wherein the toner supplied to the image carrier by the developer carrier is prevented from being transferred to the transfer receiving material while the toner recovery device recovers the toner from the developer in the developing device. Therefore, the developer loaded in the developing device is gradually decreased in the toner content.

If the magnet member is rotated to reposition the magnetic poles thereof when the above toner recovery operation is performed, the magnetic pole of the magnet member that is located opposite the developer in the developing device is shifted, attracting the developer at different place in the developing device and allowing the attracted developer to be retained on the developer carrier. It is particularly effective to bring the magnetic pole of the magnet member close to the developer in the developing device because the developer in the developing device is strongly attracted by the nearby magnetic pole of the magnet member so as to be efficiently retained on the developer carrier.

Therefore, in the case where the developer in the developing device suffers from the carrier deterioration so as to be replaced with a fresh developer, the image forming apparatus of the invention can efficiently recover the toner from the developer to be replaced although a special recovery device is not provided. In this manner, the reduction of wastefully discarded toner can be achieved easily.

When the above-described toner recovery operation is carried out in this image forming apparatus, the above bias voltage source applies, between the developer carrier and the image carrier, the developing bias voltage that is raised in the positive direction to supply the toner from the developer carrier to the image carrier. Such a developing bias voltage allows less of the carrier of the developer to be supplied to the image carrier but allows more of the toner of the developer to be supplied to the image carrier. Particularly, it is ensured that the toner of the developer retained on the developer carrier is adequately supplied to the image carrier even if the magnetic poles of the magnet member are repositioned and the magnetic pole in the opposed relation to the image carrier is displaced as described above.

Although the present invention has been fully described by way of examples, it is to be noted that various changes and modifications will be apparent to those skilled in the art.

Therefore, unless otherwise such changes and modifications depart from the scope of the present invention, they should be construed as being included therein.

The invention claimed is:

1. An image forming apparatus comprising:

a developing device that allows a developer including a toner and a carrier to be retained on a developer carrier having a magnet member equipped with a plurality of magnetic poles mounted on an inner periphery thereof and rotates the developer carrier to deliver the developer to an image carrier and that forms a toner image by supplying the toner of the developer to the image carrier by applying a developing bias voltage from a bias voltage source between the developer carrier and the image carrier;

a transfer device for transferring the toner image formed on the image carrier to a transfer receiving material;

a toner recovery device for recovering the toner remaining on the surface of the image carrier after the transfer of the toner image; and a toner return device for returning to the developing device the toner recovered by the toner recovery device, wherein the magnet member is rotated to bring a magnetic pole included in the plurality of magnetic poles opposite to the developer closer to the developer in the developing device at the time of a toner recovery operation in which the toner supplied from the developer carrier to the image carrier is prevented from being transferred to the transfer receiving material while the toner recovery device is operated to recover the toner from the developer in the developing device;

wherein the rotation of the magnet member increases the amount of toner attracted to the developer carrier.

2. The image forming apparatus according to claim 1, wherein at the time of the toner recovery operation, the developing bias voltage applied by the bias voltage source between the developer carrier and the image carrier is raised in a positive direction to supply the toner from the developer carrier to the image carrier.

3. The image forming apparatus according to claim 1, wherein the returning of the toner to the developing device by the toner return device is suspended during the toner recovery operation.

* * * * *